United States Patent [19]

Heer

[11] 3,958,927

[45] May 25, 1976

[54] METHOD OF DYEING JUTE-BACKED POLYAMIDE CARPETING

[75] Inventor: Rudolf Heer, Marietta, Ga.

[73] Assignee: Sandoz, Inc., Hanover, N.J.

[22] Filed: May 28, 1974

[21] Appl. No.: 473,520

[52] U.S. Cl. ..... 8/21 B; 8/169

[51] Int. Cl.[2] ..... D06B 3/82

[58] Field of Search ..... 8/21 B, 169

[56] References Cited

UNITED STATES PATENTS

| | | | |
|---|---|---|---|
| 3,071,427 | 1/1963 | Buehler et al. | 8/22 |
| 3,429,647 | 2/1969 | Yao et al. | 8/21 A |
| 3,758,269 | 9/1973 | Bartsch et al. | 8/21 B |

*Primary Examiner*—William F. Hamrock

*Attorney, Agent, or Firm*—Gerald D. Sharkin; Richard E. Vila; Joseph J. Borovian

[57] ABSTRACT

The staining of the face fibers of cationic-dyeable polyamide jute-backed carpeting by cationic dyestuffs employed in dyeing the jute-backing is prevented, without significant loss of color yield on the jute, by dyeing the jute at a temperature not exceeding 90°F. in the presence of an acid addition salt of a compound of the formula:

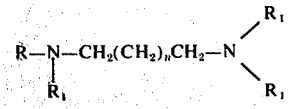

where R is an aliphatic hydrocarbon group containing 8 to 24 carbon atoms, $R_1$ is a hydroxyalkyl group of 2 or 3 carbon atoms, and n is 0, 1 or 2, or a mixture of such acid addition salts.

6 Claims, No Drawings

METHOD OF DYEING JUTE-BACKED POLYAMIDE CARPETING

This invention relates to a method of dyeing jute-backed polyamide carpeting, and more particularly, to a method of dyeing jute with basic, i.e., cationic dyestuffs, without staining the cationic-dyeable polyamide carpet face fibers.

Synthetic polyamides, such as those used in the face fibers of modern-day carpeting, are normally dyeable with acid and basic dyes to permit multitone effects. Moreover, it is often necessary to dye the jute backing, especially when the jute backing will be visible through the pile. Since jute is normally dyeable with basic dyes, various problems are encountered in the production of dyed jute-backed polyamide carpeting containing basic dyeable face fibers, prominent of which is the tendency of the basic-dyeable face fibers to become stained during dyeing of the jute.

A variety of less than satisfactory solutions have been offered for the problem. The use of levelling agents such as described in U.S. Pat. No. 3,472,607 has been proposed; and similarly, the application of salts of zirconium in the presence of a nitrogen-containing base to the jute is found in U.S. Pat. No. 3,429,647. Such techniques, however, do not permit dyeing of the jute without staining the polyamide face fibers.

It has also been proposed to employ compounds which are cationic surface active agents which block the basicdyeable polyamide face fiber sites, but finding suitable and effective materials of this type which also will not interfere with the dyeing of the jute and/or create other problems has been far from a simple matter. For example, in U.S. Pat. No. 3,758,269, it is indicated that certain cationic surface active agents which are monoamine or ammonium salts containing certain hydrocarbon and/or 2-hydroxypropyl groups and a total of 16 to 45 carbon atoms can be used to reserve or prevent the staining of cationic-dyeable nylon face fibers against basic dyes which dye the jute backing while it is also indicated that a number of other cationic surface active agents such as lauryl trimethylammonium chloride, lauryl benzyldimethylammonium chloride and lauryl pyridinium chloride are unsatisfactory for the purpose.

Accordingly, an object of this invention is to provide chemical agents useful to permit the dyeing of jute in a jute-backed polyamide-containing carpet without staining of the face fibers.

Another object of this invention is to provide a method for dyeing jute in a jute-backed polyamide-containing carpet without staining the cationic-dyeable polyamide carpet face fibers.

Still another object of this invention is to provide a low temperature method for dyeing jute in a jute-backed polyamide-containing carpet without staining the cationic-dyeable polyamide carpet face fibers.

In accordance with the present invention, a low temperature method for dyeing the jute of jute-backed polyamide carpeting containing cationic-dyeable polyamide carpet face fibers in which the face fibers have been dyed is provided by treating jute-backed polyamide carpeting with a water-soluble acid addition salt of a compound of formula I:

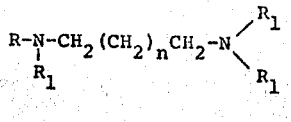

I where

R is an aliphatic hydrocarbon group containing 8 to 24 carbon atoms, each of $R_1$ is independently a hydroxyalkyl group of 2 or 3 carbon atoms, and n is 0, 1 or 2, or a mixture of acid addition salts of the compounds of formula I.

In carrying out the present invention, the jute-backed polyamide carpeting, of which all of the carpet face fibers have been dyed, is treated in a bath containing at least one compound of formula I in water-soluble acid addition salt form at a concentration of about 0.10 to about 2.0 percent (based on the total weight of the carpet) at a pH between 3 and 7 and a temperature not exceeding 90°F. for a period of time between 3 and 20 minutes, preferably between 5 and 15 minutes, after which at least one basic dyestuff is added to the bath and the jute dyed at a temperature not exceeding 90°F. and a pH between 3 and 11. The dyeing of the jute is generally complete within 3 to 30 minutes, more usually within 5 to 20 minutes, at which time the jute-treated/dyed carpeting is removed from the bath, rinsed with water and optionally subjected to additional treatment.

The compounds of formula I represent a class of compounds which are well known in the art and thus their preparation by conventional procedures is similarly well known. The acid addition salts thereof are readily formed by well-known conventional procedures involving the reaction of a compound I with any water-soluble, innocuous inorganic or organic acid such as hydrochloric acid, sulfuric acid, phosphoric acid, acetic acid, formic acid, citric acid, methanesulfonic acid, and the like. For example, a preferred stain inhibitor in stable storable form may be prepared by simple mixing of 25 parts by weight of N-tallowyl-N-(2-hydroxyethyl)-N-[3-bis(2-hydroxyethyl)aminopropyl]amine hydrochloride with a solution of 10 parts of 91 percent isopropanol in 63 parts of water followed by the slow addition with mixing of 2 parts of 36 percent hydrochloric acid.

Examples of the stain inhibitors suitable for the purpose of this invention include N-decyl-N-(2-hydroxyethyl)-N-[3-bis(2-hydroxyethyl)aminopropyl]amine hydrochloride, N-stearyl-N-(2-hydroxyethyl)-N-[3-bis(2-hydroxyethyl)aminopropyl]amine hydrochloride, N-lauryl-N-(2-hydroxyethyl)-N-[3-bis(2-hydroxyethyl-)aminopropyl]amine hydrochloride, N-myristyl-N-(2-hydroxyethyl)-N-[3-bis(2-hydroxyethyl)aminopropyl-]amine hydrochloride, N-palmityl-N-(2-hydroxyethyl)-N-[2-bis(2-hydroxyethyl)aminopropyl]amine hydrochloride, N-palmityl-N-(3-hydroxypropyl)-N-[3-bis(3-hydroxypropyl)aminopropyl]amine hydrochloride, N-palmityl-N-(2-hydroxyethyl)-N-[3-bis(2-hydroxyethyl-)aminopropyl]amine acetate. The long hydrophobic, aliphatic chain (R) of the stain inhibitors may be monounsaturated as well as saturated, straight-chain or branched. The generally preferred stain inhibitors are those involving one or more compounds I wherein R is a hydrocarbon group containing 14 to 18 carbon atoms, each of $R_1$ is hydroxyethyl and n is 1 in the generic formula above, or mixtures thereof containing not more than 75 percent by weight of a compound I in which R is a monounsaturated group of 14 to 18 carbon atoms. As a practical matter, the stain inhibitor employed will be a mixture of two or more of the stain inhibitors by reason of the derivation of the compounds from fatty acid sources. For example, a particularly preferred stain inhibitor is derived from a mixture of $C_{14}$ to $C_{18}$ fatty acids as obtained from tallow oil and a preferred stain inhibitor is referred to herein as N-tallowyl-N-(2-hydroxyethyl)-N-[3-bis(2-hydroxyethyl-)aminopropyl]amine hydrochloride.

Since carpet construction varies widely, the relative amount of jute and cationic dyeable carpet face fibers are quite variable in practice. The amount of acid addition salt required to prevent staining of the face fibers may be varied over a range of at least 0.10 to about 2.0 percent on the total carpet weight, and preferably from about 0.20 to about 1.0 percent, more preferably 0.25 to 0.75 percent. Greater than 2.0 percent of the acid addition salt results in no improvement in the prevention of the staining of the face fibers with the cationic or basic dyestuff used to dye the jute.

The basic dyeable carpet face fibers may be all polyamide or nylon fibers or may be blends of polyamide or nylon fibers with other types of textile fibers.

One or more basic dyestuffs may be employed in the dyeing of the jute and may be any of the basic dyes which are known for this purpose to those skilled in the art.

It is important that the temperature of the bath not exceed 90°F., preferably not exceeding 80°F., during the treating of the jute-backed polyamide carpeting with the stain inhibitor and during the dyeing of the jute, otherwise the carpet face fibers will become stained with the basic dyes which are employed to dye the jute. Although the treating of the jute-backed polyamide carpeting and dyeing of the jute may be carried out at temperatures as low as 40°F., it is preferred that the treating of the jute-backed polyamide carpeting and dyeing of the jute be carried out at a temperature between 65° and 80°F.

Although the pH of the bath during the treating of the jute-backed polyamide carpeting with the stain inhibitor may be between 3 and 7 and the pH of the bath during the dyeing of the jute may be between a value of about 3 to 11, it is preferred that both baths have a pH between 4 and 6. The pH of the baths is usually adjusted within a suitable range for the particular dye or dyes being used, and it is within the purview of one skilled in the art to adjust the pH of the medium to a suitable pH. The pH of the dyebath may be adjusted by employing acids such as acetic acid, formic acid, hydrochloric acid, phosphoric acid and sulfuric acid, bases such as trisodium phosphate, tetrasodium pyrophosphate, ammonia, sodium hydroxide and buffering compounds such as monosodium phosphate, borax, sodium formate and acetic acidsodium acetate mixtures. It is within the scope of this invention to add small amounts of conventional retarders or dye levelling agents as solubilizers below the concentrations at which they retard basic dyes from the jute. It is also within the purview of one skilled in the art to add other agents or additives which will not adversely affect the practice of the present invention.

Although the baths of this invention may contain any amount of water, it is preferred that the ratio of water to total carpet weight be between 10:1 to 50:1, more preferably between 15:1 to 25:1. By total carpet weight is meant the weight of the face fibers plus the jute backing.

The acid addition salts of this invention may be applied to the jute-backed polyamide carpeting by spraying, padding, roll application, immersing or by any other method which enables impregnation of the acid addition salt prior to the addition of the basic dyestuff, as will be evident to those skilled in the art.

The following examples illustrate the preferred procedure to be followed in accordance with this invention; however, it should be understood that the examples are all illustrative only and not exclusive.

EXAMPLE 1

A jute-backed multifiber nylon carpet containing acid and basic dyeable yarn is dyed in the conventional manner with a combination of 0.377 percent Nylosan Blue C-2AL, 0.190 percent Sandocryl Brilliant Yellow B-6GL and 0.095 percent Sandocryl Blue B-2GLE. In the resulting carpet, the acid dyeable yarn is dark blue, the basic dyeable nylon is light green and the jute portion of the carpet is not dyed. After rinsing, the multitone carpet is treated in a bath containing 0.75 percent N-tallowyl-N-(2-hydroxyethyl)-N-[3-bis(2-hydroxyethyl)aminopropyl]amine hydrochloride for a period of 7–8 minutes at a temperature between 65° and 70°F., said bath exhibiting a pH of 4.5 and a liquor to carpet ratio of 20:1. After 7–8 minutes, 0.05 percent Methylene Blue 2B Conc is added and the bath maintained at a temperature of between 65° and 70°F. and a pH between 4 and 6 for 15 minutes, after which time the carpet is rinsed and dried. The face fibers are unchanged and the jute is dyed to a blue-green shade (all percentages based on the total carpet weight).

EXAMPLE 2

A jute-backed multifiber nylon carpet containing cationic dyeable DuPont type 844 nylon, reduced affinity acid dyeable DuPont type 845 nylon, and deep dyeing affinity acid dyeable DuPont type 847 nylon is dyed in the conventional manner with a combination of 0.80 percent Nylosan Yellow C-SLW, 0.23 percent Nylosan Red C-2GN and 0.32 percent Nylosan Blue C-2GL. The carpet has a multicolored effect including areas of white reserve and the jute is not dyed. After rinsing, the carpet is treated in a bath containing 0.75 percent N-tallowyl-N-(2-hydroxyethyl)-N-[3-bis(2-hydroxyethyl)-aminopropyl]amine hydrochloride in the manner described in Example 1, after which 0.16 percent Methylene Blue 2B Conc, 0.125 percent Sandocryl Yellow B-GL and 0.83 percent Sandocryl Brilliant Red B-4G is added to the bath and the jute backing dyed a heavier shade, again in the manner described in Example 1. The face fibers including the undyed basic dyeable areas are unchanged and the jute is dyed to the desired shade (all percentages based on the total carpet weight).

EXAMPLE 3

The jute-backed multifiber carpet of Example 2 is dyed in the conventional manner with a combination of 0.377 percent Nylosan Blue C-2AL, 0.190 percent Sandocryl Brilliant Yellow B-6GL and 0.095 percent Sandocryl Blue B-2GLE. The carpet has a multicolored effect and the jute is not dyed. After rinsing, equal portions of the carpet are treated in a bath for a period of 10 minutes at a temperature between 65° and 70°F., said baths exhibiting a pH of 4.5 and a liquor to carpet ratio of 20:1, and each of said baths containing one of the following additives:

A. Control-no additive,

B. 0.25 percent N-tallowyl-N-(2-hydroxyethyl)-N-[3-bis(2-hydroxyethyl)aminopropyl]amine hydrochloride, C. 0.75 percent N-tallowyl-N-(2-hydroxyethyl)-N-[3-bis(2-hydroxyethyl)aminopropyl]amine hydrochloride, D. 0.25 percent N-myristyl-N-(2-hydroxyethyl)-N-[3bis(2-hydroxyethyl)aminopropyl]amine hydrochloride, or E. 0.25 percent N-lauryl-N-(2-hydroxyethyl)-N-[3-bis(2-hydroxyethyl)aminopropyl]amine hydrochloride.

After 10 minutes, 0.05 percent of Methylene Blue 2B Conc is added to each bath and the baths maintained at a temperature between 65° and 70°F. for 15 minutes, followed by rinsing, then drying (all percentages based on the total carpet weight).

In the carpet samples treated with additives B)-E), stain inhibitors encompassed by the present invention, the dyeings were satisfactory with respect to both lack of staining of the cationic dyeable nylon and full color yield of the basic dyes on the jute backing; control sample A) exhibited heavy staining of the cationic dyeable nylon.

As many different embodiments of this invention may be made without departing from the spirit and scope thereof, it is to be understood that the invention is not limited to the specific embodiments disclosed herein.

What is claimed is:

1. In a method for dyeing the jute of jute-backed polyamide carpeting containing already dyed cationic-dyeable polyamide carpet face fibers, the improvement which comprises the steps of: i) treating the jute-backed polyamide carpeting prior to the dyeing of the jute in a bath containing a water-soluble acid addition salt of a compound of the formula:

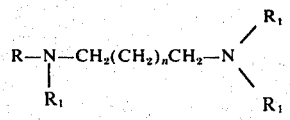

where

R is an aliphatic hydrocarbon group containing 8 to 24 carbon atoms, each of $R_1$ is independently a hydroxyalkyl group of 2 to 3 carbon atoms, and n is 0, 1 or 2, or a mixture of said acid addition salts, at a temperature not exceeding 90°F. and at a pH of about 3 to 7, and ii) dyeing the jute of said treated jute-backed polyamide carpeting with at least one cationic dyestuff at a temperature not exceeding 90°F. and at a pH of from 3 to 11, whereby the jute is dyed and the carpet face fibers are substantially free from staining by said cationic dyestuff.

2. The method of claim 1 wherein treating of said polyamide carpeting and dyeing of said jute is effected at a temperature not exceeding 80°F. and a pH of about 4 to 6.

3. The method of claim 1 wherein said jute-backed polyamide carpeting is treated with at least 0.20 percent based on the total carpet weight, of said water-soluble acid addition salt.

4. The method of claim 3 wherein said jute-backed polyamide carpeting is treated with said water-soluble acid addition salt for a period of time between 5 and 15 minutes.

5. The method of claim 3 wherein said jute-backed polyamide carpeting is treated with a water-soluble acid addition salt of a compound of the formula:

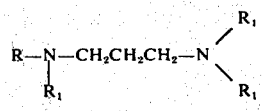

where

R is an aliphatic hydrocarbon group containing 14 to 18 carbon atoms, and each of $R_1$ is hydroxyethyl, or a mixture thereof.

6. The method of claim 5 wherein said jute-backed carpeting is treated with N-tallowyl-N-(2-hydroxyethyl)-N-[3-bis(2-hydroxyethyl)aminopropyl]amine hydrochloride.

* * * * *